United States Patent [19]

Miller, Jr.

[11] 4,179,085

[45] Dec. 18, 1979

[54] OPTICAL BORESIGHT METHOD FOR NUTATING SYSTEM

[75] Inventor: Walter E. Miller, Jr., Huntsville, Ala.

[73] Assignee: The United States of America as represented by the Secretary of the Army, Washington, D.C.

[21] Appl. No.: 866,580

[22] Filed: Jan. 3, 1978

[51] Int. Cl.[2] ..... F41G 3/32; F41G 11/00; F41G 1/00; F41G 1/54

[52] U.S. Cl. ..... 244/3.11; 244/3.13

[58] Field of Search ..... 244/3.11, 3.13

[56] References Cited

U.S. PATENT DOCUMENTS

| | | | |
|---|---|---|---|
| 2,930,894 | 3/1960 | Bozeman | 244/3.11 |
| 3,974,383 | 8/1976 | Chapman | 244/3.11 |
| 4,038,547 | 7/1977 | Hoesterey | 244/3.11 |

*Primary Examiner*—Samuel W. Engle
*Assistant Examiner*—Thomas H. Webb
*Attorney, Agent, or Firm*—Nathan Edelberg; Robert P. Gibson; Freddie M. Bush

[57] ABSTRACT

A method for eliminating boresight error in a beamrider missile guidance system wherein moving parts may disrupt alignment of a nutated beam. Periodic strobing of a light emitting source directs beams of light to form an optical reticle which may function as either the boresight alignment check source or as the telescope aiming reticle.

5 Claims, 6 Drawing Figures

OPTICAL BORESIGHT METHOD FOR NUTATING SYSTEM

DEDICATORY CLAUSE

The invention described herein may be manufactured, used, and licensed by or for the Government for governmental purposes without the payment to me of any royalties thereon.

BACKGROUND OF THE INVENTION

Boresight alignment of multiple optical systems can be accomplished by several means, including full range operation of the systems, with adjustment to correct errors. Some systems require automatic boresight alignment, which can be more difficult to achieve. Typical of these state-of-the-art methods for boresight alignment are field measurement and autotracking methods.

For field measurement, the several optical systems to be aligned are operated normally over a range sufficiently long to reduce parallax to an acceptable level. A single "target" is utilized, which possesses appropriate markings, signature providing sources, or receiving devices compatable with each of the optical systems. Each optical system is then adjusted to a null condition on its respective target signature or receiving device, which accomplishes boresight alignment due to the collocation of the target devices on the single "target". The principal disadvantages of this method are the requirements for a special purpose target board, for full operation over long ranges, and for the time required for full system operation.

For autotracking, a special purpose automatic boresight alignment technique is used in an existing missile system. Typically, as shown in FIG. 1, two optical systems are to be aligned, an infrared tracker and a visual sighting telescope. Normal operation of these two systems is as follows: a distant, visible, target scene is received by the visual sighting telescope objective 10 and is focused at an image plane 12 where it can be viewed by an operator 14 through eyepiece 16. Image plane 12 contains a reticle, which enables the operator to accurately point the telescope. Infrared tracker 20 together with objective optics 22 is then accurately directed toward the same target by virtue of a previous boresight alignment between the tracker 20 and the reticle of image plane 12 of the two optical systems.

Automatic boresight alignment is accomplished as follows: infrared tracker 20 contains provisions for illuminating the center 13 of visual reticle 12 with the infrared signature required by the tracker. Objective optics 10 collimates this infrared energy, projecting a beam along the telescope boresight axis as defined by the reticle center toward target 24. A retro-directive prism 18 collects a portion of this collimated energy and directs it into tracker objective optics 22, exactly parallel, but opposite in direction to the projected beam. Tracker 20 then receives this retro-directed energy, and is repositioned by an operator until boresight is indicated. When the tracker error signal output is nulled, the tracker is effectively tracking the visual reticle projected to infinity, and thus the visual telescope and infrared tracker have achieved a common boresight alignment.

FIG. 2 shows another optical system similar in function to FIG. 1, for providing injection boresight alignment. In this case, a special light source 30 is required, which produces both visible light and modulated infrared light compatible with tracker 20. This light source is collimated by optics 32, retro-directed by prism 34, and tracked by tracker 20 as done in autotracking. Either tracker 20 or light source 30 may be repositioned to produce the tracker null condition. Additionally, prism 36 redirects a portion of the collimated light into the telescope objective 10, which is then observable by the observer 14 as a pinpoint of light near the reticle center. Positioning of the reticle to exactly coincide with the projected pinpoint of light then completes boresight adjustment.

SUMMARY OF THE INVENTION

In an optical beam projecting system as in a beamrider missile guidance system, boresighting a visual sighting device with the beam projecting system cannot be accomplished by automatic boresight adjustment methods used with tracking devices. Selectively strobing a light emitting source adjacent and aligned with the optical source for the projected beam synchronously with known positions of a nutator beam allows the visual sighting device reticle to be illuminated by retro-directed energy. This beam does not require boresight adjustment, as it is itself the boresight check source and may be used as the visual sighting device aiming reticle.

DESCRIPTION OF THE PREFERRED EMBODIMENT

Figure 1:
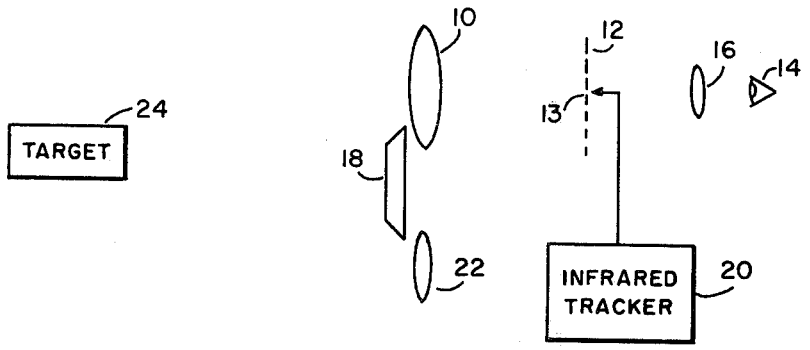
FIG. 1 (PRIOR ART)
FIG. 1 is a diagrammatic view of a typical prior art arrangement for automatic boresight alignment.
Figure 2:
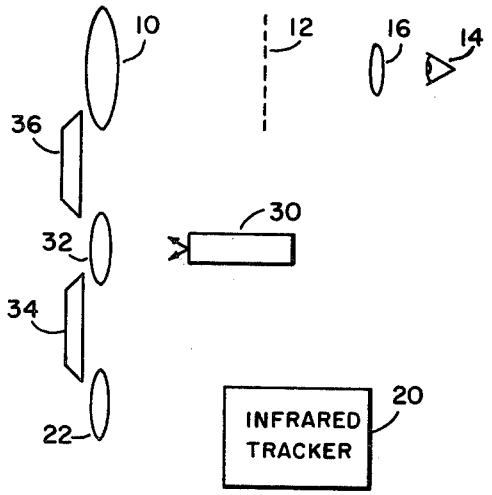
FIG. 2 (PRIOR ART)
FIG. 2 is a diagrammatic view of a typical prior art arrangement for injection boresight alignment.
Figure 3:
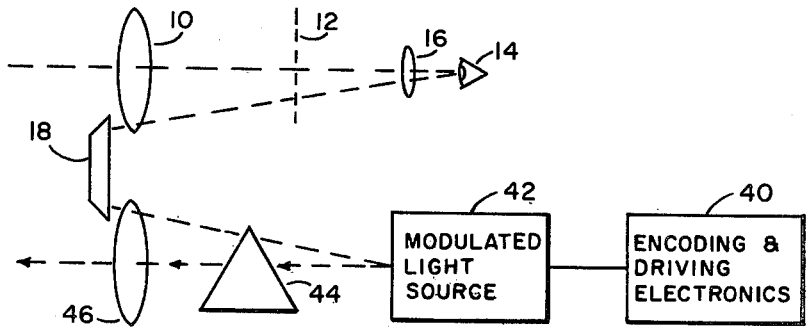
FIG. 3 is a simplified diagrammatic view of a beamrider missile guidance transmitter and visual sighting device.

Where it is required to boresight an optical telescope or other visual sighting device to a beam projecting system as in beamrider missile guidance systems, neither of the prior art boresight adjustment methods described may be incorporated since the beam transmitter is not a tracking device and does not provide an error signal. FIG. 3 shows a simplified optical schematic of a beamrider missile guidance transmitter and sight. The telescope is identical to that of FIGS. 1 and 2, previously described. The beam transmitter for a beamrider guidance system consists of encoding and drive electronics 40, modulated light source 42, nutating mechanism 44, and projecting optics 46. The nutating mechanism 44, shown as an optical prism, causes deviation in the beam projected angle when rotated. This angular nutation is required for the missile guidance, however, it blurs the image seen by gunner or observer 14 of light retro-directed by prism 18 even if such light were visible. This method describes a means for overcoming this blurring and using the observer to visually determine boresight. Beamrider guidance is disclosed in U.S. Pat. No. 3,782,667 issued to W. E. Miller, Jr. et al, disclosing the established nature of beamrider guidance electronics and optics.

Figure 4:
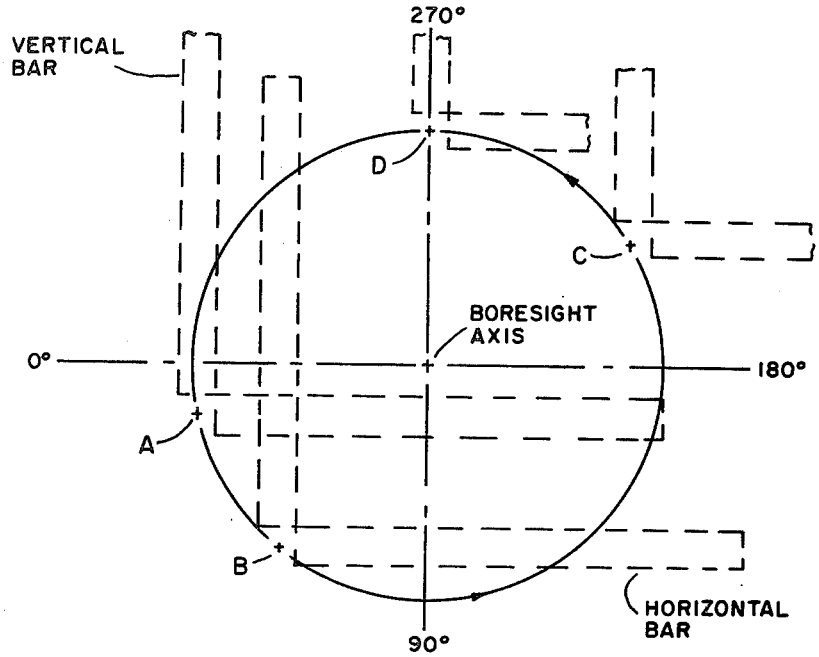
FIG. 4 is the diagrammatic image of a beamrider transmitter focal plane, which is also superimposed on the image plane of the sighting device of FIG. 3.

FIG. 4 shows an "L" shaped focal plane image, a typical configuration used with this type of transmitter. The vertical and horizontal bars shown in dashes are infrared beams of light from light source 42. These modulated, infrared beams are directed toward a target for guiding a missile toward the target as set forth in prior art. Also, however, retro-director 18 images this pattern at the reticle 12 even though this infrared energy is invisible to the gunner or operator viewing through the scope. Typically, the vertical bar crosses the circular field of view of the scope from left to right as the nutation moves from zero degrees to 180 degrees of rotation through positions A and B. During the remaining 180 degrees of rotation, back to zero degrees, the vertical bar is outside the circular field of view as shown at positions C and D. A similar sequence holds for the horizontal bar which starts scanning from top to bottom, going across the circle as the beam moves from 270 degrees to 90 degrees of rotation, going through positions, D, A, and B. While these beams are invisible to an operator, their position in space and as retroreflected to the reticle 12 coincides with precise positions of the nutating mechanism which scans the beams. The intersection of the two bars describe a circle outlining the guidance field of view due to the nutating scan. The guidance field is the area swept by both the horizontal and vertical bars during a nutation cycle.

Figure 5:
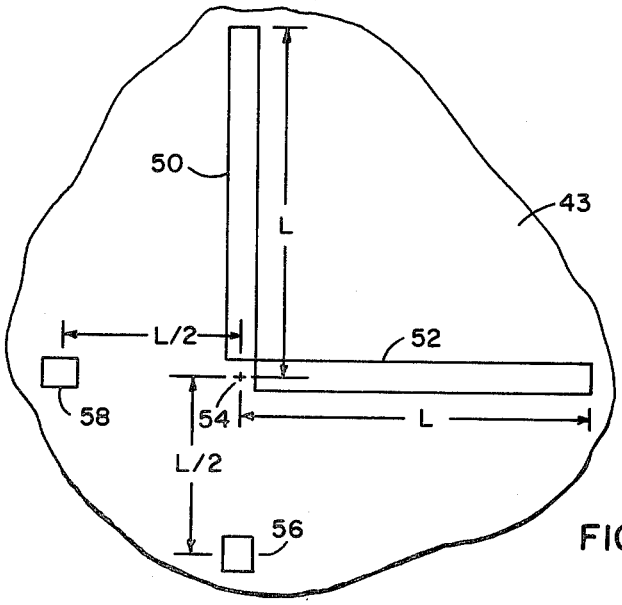
FIG. 5 is a diagrammatic drawing of the modulating light source focal plane.

As shown in FIG. 5, a face plate 43 of light source 42 is shown having a vertical opening 50, or other beam forming optics, for shaping the beam directed to the nutating mechanism 44. Similarly a horizontal opening 52 is adapted for directing a horizontal bar to the nutator. By placing a visible light source 54, such as a light emitting diode (LED) or diode array, at the intersection of the axes of infrared sources 50 and 52, a continuous visible beam is transmitted during nutation of the tracing beam. Positions A, B, C, and D of FIG. 4 depict the dot of light from LED 54 imaged at focal plane 12 by retro-director 18 and other optics shown in FIG. 3 if the nutator is held stationary at the selected points A, B, C, and D of rotation. However, the nutator cannot be held stationary and since continuous rotation occurs, a large circular blur is all that is detectable. The image seen by an observer is the blurred circle of FIG. 4, describing the edges of the projected guidance beam. The boresight axis is the center of this circular pattern and the observer need only align the reticle crosshairs of the scope with the center of the optical circle to identify the boresight to the target image.

However, as shown at FIG. 5, light emitting diodes 56 and 58 may be used in addition to or in place of LED 54 to identify boresight. At position D of FIG. 4 (270 degrees of rotation from the designated 0 degree position) the center of nutation lies directly below the vertical bar a distance equal to the nutation radius L/2. This center of nutation is always the beam boresight axis. Thus, light emitting diodes 56, or other modulatable visible optical sources may be illuminated when the image is at position D (flashing once each rotation) and provide a precise indication of the transmitter boresight axis to the observer. Similarly, when the horizontal beam is at 180 degrees of rotation, LED 58 may be stimulated to emission to identify the boresight axi. It is obvious from the foregoing that other combinations of reticle location and nutator position could likewise be used by strategic location of visible light emitting sources. The result is an illuminated reticle, projected to the observer, that does not require boresight adjustment as do conventional reticles, since it originates at the same focal plane 43 as the modulated beam sources 50 and 52, and is collimated by the same optics 44 and 46 that are used for the beamrider projection. Positional error in these elements then affect the projected beam and the imaged reticle in identical ways. The periodically flashing diodes of FIG. 5 are transmitted by optics 44, 46, 18, and 10 to visual reticle 12 and the center of this image is the boresight axis regardless of where the scope crosshairs are. The operator may then through eyepiece 16 view and manually adjust the crosshairs so that they are aligned to the strobed diode light source transmitted with the nutated beam, or the scope reticle may be ignored and the optically projected point on the scope may be used independently as the boresight axis.

Figure 6:
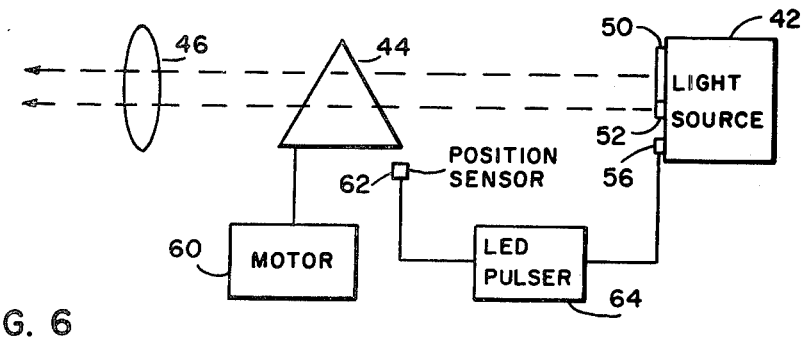
FIG. 6 is a diagrammatic drawing of a preferred embodiment of an optical reticle generating circuit for a nutating system of FIG. 3.

FIG. 6 is a more detailed drawing, diagrammatically showing the operation of the optical reticle generating circuit. Light source 42 is aligned with nutator 44 and optics 46 for directing modulated light bars through openings 50 and 52 for beamrider guidance. As motor 60 rotates the nutator 44 the beam is nutated and a position sensor 62 triggers the LED pulser 64 once during each rotation of the nutator which activates or fires the LED 56. The diode optical output is then imaged at the telescope reticle, in a manner similar to the prior art, FIG. 2. The particular position on the reticle of the light from the diode is determined by the diode placement on the light source with respect to the fixed beamrider sources and the placement of the trigger for position sensor 62. Obviously several sensors and light sources can be selectively triggered as the nutator rotates, as may be required or desired for a system.

Thus, during operation, the modulated infrared beams for missile guidance, the LED's, and the power supply for the nutator are turned on. Either diode 56 or 58 (FIG. 5) may be strobed to indicate the boresight axis, or both may be strobed to present a stronger signal to the observer. Additionally diode 54 may be continuously emitting to visibly define the circle of FIG. 4. The operator, looking through the telescope has only to center the reticle on the pinpoint of light retro-directed from the flashing LED; or center the reticle within the circle if only the circle is being projected.

Although a particular embodiment and form of the invention has been described, it will be obvious to those skilled in the art that modification may be made without departing from the scope and spirit of the invention. Accordingly, it is understood that the invention is limited only by the claims appended hereto.

I claim:

1. In a beamrider guidance system wherein rotation of a nutating device moves an optical beam to periodically vary the inclination of the beam axis, a method for determining and maintaining boresight alignment of the nutating system with an adjacent optical telescope on the same stable platform comprising the steps of:

directing a beam of optical energy generated by said guidance system through said nutating mechanism;

emitting rapid, brief, directional flashes of visible light through said nutating mechanism at preselected points around the plane of rotation of the nutating device for providing a visible optical reference in said modulated beam for identifying said boresight;

nutating said beam;

retro-directing a portion of said beam in a plane parallel to and opposite in direction to said directed beam;

capturing said retro-directed beam in a telescope;

displaying said retro-directed beam on the focal plane of said telescope; and observing said directional flashes of optical energy displayed on said telescope focal plane for identifying the beamrider guidance system boresight.

2. A method for determining and maintaining boresight alignment of a nutating system with an adjacent optical tracking system as set forth in claim 1 wherein said step of emitting directional flashes of visible light occurs at respective 90 degrees and 180 degrees from an established zero degree reference for providing a visible pinpoint of light identifying the axis of said boresight.

3. A method for determining and maintaining boresight alignment as set forth in claim 2 and further comprising the step of adjusting the telescope reticle crosshairs so that they are aligned with the optical pinpoint identifying the center of the circle.

4. A method for determining and maintaining boresight alignment as set forth in claim 3 and further comprising the step of continuously generating a beam of visible light for describing an optical circle indicative of the boresight, the center of said circle being the boresight axis.

5. A method for determining and maintaining boresight alignment as set forth in claim 1 and further comprising the step of continuously generating a beam of visible light for describing an optical circle indicative of the boresight, the center of the circle being the boresight axis.

* * * * *